US006098212A

United States Patent [19]

Rogan

[11] Patent Number: 6,098,212

[45] Date of Patent: Aug. 8, 2000

[54] PLUMBING APPARATUS

[76] Inventor: James M. Rogan, 928 Stratford La., Dyer, Ind. 46311

[21] Appl. No.: 09/255,143

[22] Filed: Feb. 22, 1999

[51] Int. Cl.[7] ..... E03D 9/00

[52] U.S. Cl. ..... 4/255.04; 4/255.01; 15/104.33

[58] Field of Search ..... 4/255.01, 255.04, 4/255.06, 255.08, 256.1; 15/104.33; 138/90, 96 R

[56] References Cited

U.S. PATENT DOCUMENTS

| | | | |
|---|---|---|---|
| 1,314,261 | 8/1919 | Griesche . | |
| 1,760,704 | 5/1930 | Lindstrom . | |
| 1,762,608 | 6/1930 | Brown . | |
| 1,796,340 | 3/1931 | Nowakowski . | |
| 1,861,899 | 6/1932 | Beach, Jr. . | |
| 2,050,365 | 8/1936 | Moss et al. . | |
| 2,066,773 | 1/1937 | Felice . | |
| 2,499,801 | 3/1950 | Tubbs | 15/104.33 |
| 3,897,601 | 8/1975 | Wusterfeld . | |
| 3,936,892 | 2/1976 | Miller | 4/255.01 |
| 4,429,568 | 2/1984 | Sullivan | 138/90 X |
| 5,107,550 | 4/1992 | Hawro . | |
| 5,682,620 | 11/1997 | Stoltz et al. . | |

*Primary Examiner*—Robert M. Fetsuga
*Attorney, Agent, or Firm*—Richard G. Kinney

[57] ABSTRACT

A kit for forming a plumbing apparatus for aiding in the snaking of drain pipes which kit includes a rubber cap having a cylindrical skirt, a circular clamp about the skirt, a snake rod receiving hole through the covered end of the cap and a flushing water tube also through the covered end of the cap. The cap can fit over and be tightened about a standard drainpipe, e.g. a 2 inch drainpipe, and adapters for coupling it to different standard sized (e.g. 1½ inch) and different threading (male or female) are provided. The flushing water tube is connected to a flexible hose of sufficient length to run to the faucet of a sink when the cap is attached to that sink's drainpipe. A back flow protector (vacuum breaker) is incorporated at the free end of the hose. The kit includes a carrying box which is waterproof and can serve as a water tight bucket for use under the drain when using the kit to snake a drain. The rubber cap is thick enough about the snake rod receiving hole to squeegee the rod as the rod is removed from the drainpipe after being use.

3 Claims, 2 Drawing Sheets

PLUMBING APPARATUS

FIELD OF THE INVENTION

The present invention is directed to a plumbing apparatus and is especially concerned with a new and improved apparatus and kit for aiding in the snaking out of drainpipes in a clean and effective manner.

BACKGROUND OF THE INVENTION

Apparatus for aiding in the snaking out of drainpipes, especially underneath sinks, have been suggested in the past. Examples of such apparatus are disclosed in U.S. Pat. Nos. 5,682,620 and 5,107,550. Other apparatus for cleaning drainpipes are disclosed in U.S. Pat. Nos. 1,314,261; 1,760,704; 1,796,340; 1,762,608; 1,861,899; 2,050,365; 2,066,773; and 3,897,601.

Despite these prior attempts, there still exists the need for an apparatus that may be easily carried by a plumber, economically manufactured and adaptable enough to be used with many different sink faucets and drainpipes. Further, prior such attempts which employed a connection to the faucet run the risk of back feeding fluids from the drainpipe into the water pipes and possibly contaminating the water therein. That is, under some circumstances, if the water pressure in the faucet drops below that in the drainpipe to which it is connected by apparatus such as that shown and described in the above mentioned U.S. Pat. Nos. 5,682,620 and 5,107,550, contaminating drainpipe fluids can flow backwards into the faucet. This may occur if the water pressure to the faucet drops unexpectedly, or if the pressure in the drainpipes increases, or both. There then exists a need for a snake aiding system that prevents such undesirable back flows.

SUMMARY OF THE INVENTION

In overcoming one or more of the drawbacks of the prior art, the present invention provides a novel kit for forming apparatus for the snaking of pipes. The kit includes a rubber cap having a cylindrical skirt section sized to fit over a standard drainpipe, with the cap being closed at one end of the skirt section. An opening sized to receive a flexible rotary snake rod is formed in the cap and a second opening receiving a nozzle tube is provided. The cap also having means for releasably securing it to the drainpipe. The tube extending through the end of said rubber cap with a hose connected to it and coupled at its other end to a water spigot such as a kitchen sink's faucet. And means are provided for providing positive back flow protection and to prevent the flow of fluids out of the hose into the faucet. The kit further includes means for adapting the rubber cap to a number of different standard sized drainpipes and drainpipe endings so as to allow the kit to be used in a large number of different snaking conditions.

DETAILED DESCRIPTION OF THE PREFERRED EMBODIMENT

Figure 1:
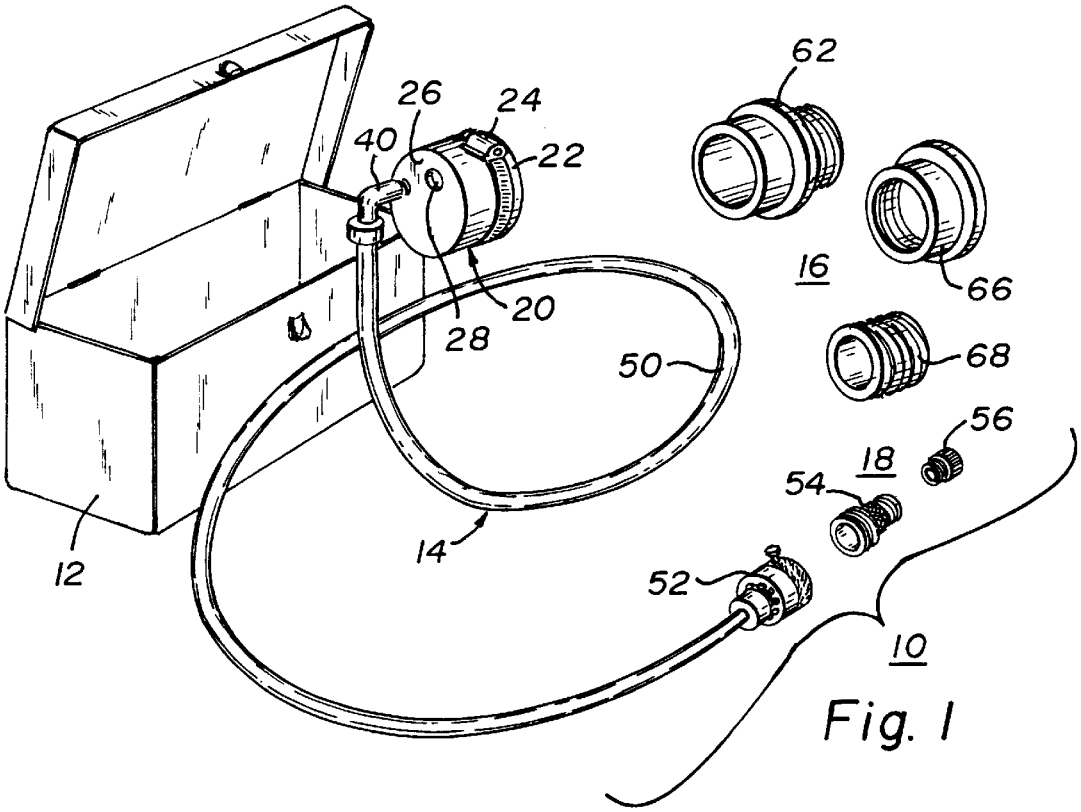
FIG. 1 is a perspective view of a kit made in accordance with the principles of the present invention.
Figure 2:
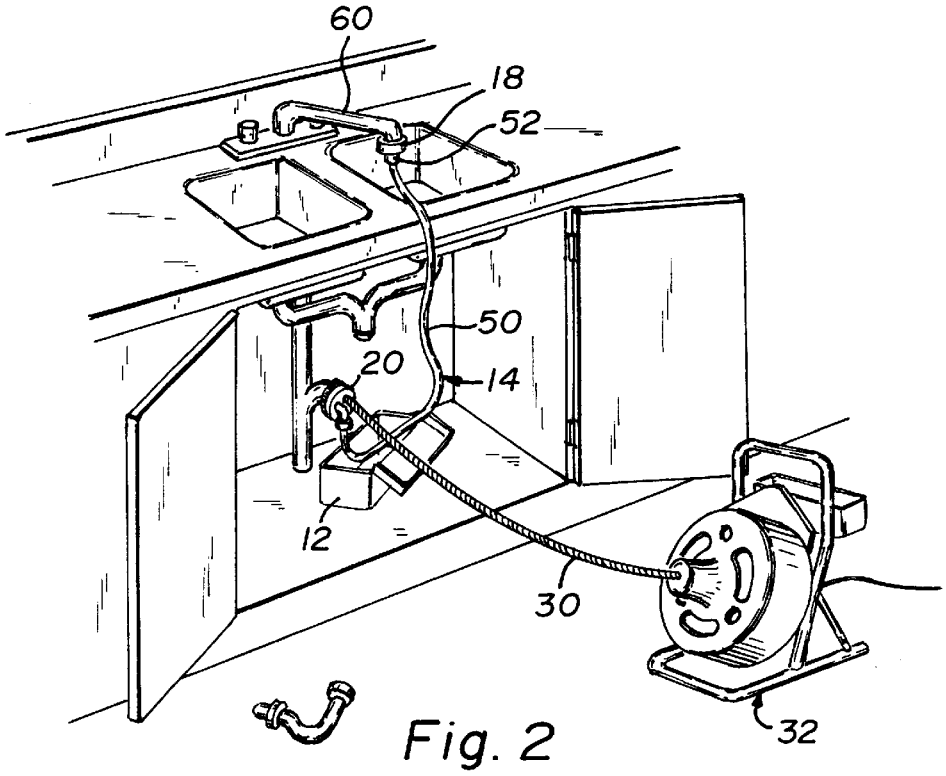
FIG. 2 is a perspective view of a kitchen sink drain being snaked out using the apparatus of the kit of the present invention and a conventional motor-driven snake.

Referring now to FIG. 1, there is depicted a kit apparatus constructed in accordance with the principles of the present invention and generally designated by the number 10. The kit 10 includes a waterproof container 12 which is sized to receive all of the parts displayed in FIG. 1 and also may serve as an undersink bucket as shown in FIG. 2. In addition to the container 12, the kit includes a novel water-flushing and rod cleaning unit 14, means 16 for adapting the unit 14 to different sized and threaded drainpipe openings, and means 18 for adapting the unit 14 to different sized and threaded faucets.

Figure 3:
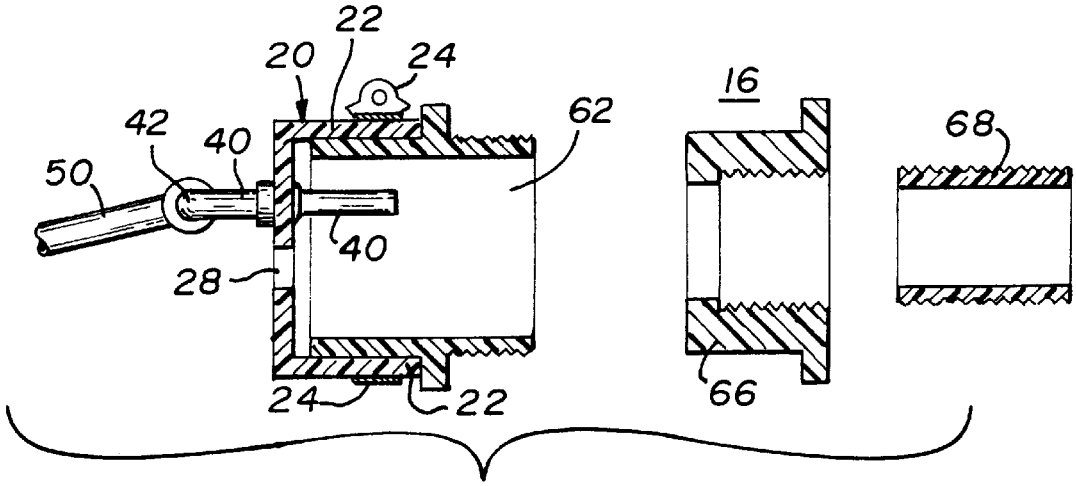
FIG. 3 is a horizontal sectional view of portions of the kit of FIG. 1 arranged so as to illustrate how the apparatus can be employed to adapt it to be attached to different sized and male or female threaded drainpipes.

In more detail, the unit 14 includes a novel rubber cap 20 which has a generally cylindrical section skirt 22 about which is a circular clamp 24. The rubber cap 20 has one end 26 closed by a rubber wall. An opening 28 through the wall 26 is sized to closely receive the flexible rotating rod 30 (FIG. 2) of a conventional motorized snake apparatus 32. As shown in FIG. 3, the rubber cap 20 is relatively thick, especially at the opening 28 so as to deform outward, lessening its effective diameter, and acting as a squeegee to the rod 30 when the rod is withdrawn from a drainpipe.

The cap 20 as best shown in FIGS. 1 and 3, includes a nozzle tube 40 which passes through the wall 26 in a substantially water tight manner. The tube 40 projects water into the drainpipe and serves to help clean the rod 30 as it is withdrawn from the pipe, as well as to provide lubricating water and aid in flushing out the drain after it is opened by the snake.

The tube 40 is preferably a ¼ inch tube and is attached to a ⅜ by ½ IPS 90 degree coupling 42. This coupling 42 is attached to a hose 50 (which may be a section of garden or washing machine hose). The opposite end of the hose 50 is, in accordance with one feature of the present invention, connected to means for preventing back flow, a vacuum breaker 52. This could be, for example, a commercially available Wilkins model BFP-8, or any similar vacuum breaker. This device 52 is attachable to a single adaptor 54 or that adaptor 54 plus a second apparatus 56 adapting means 18. Such adapters are well known in this art and need not be described in detail. They serve the purpose of allowing the hose 50 to be connected through device 52 and one or more adapters 18 to a faucet such as the faucet 60 shown in FIG. 2.

Figure 4:
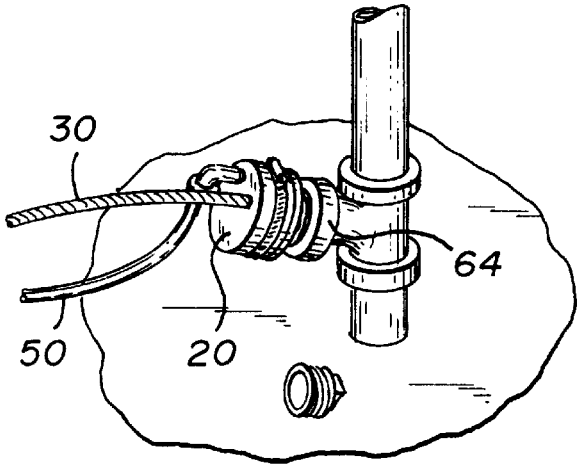
FIG. 4 is a perspective view of the apparatus from the kit of FIGS. 1 and 3 adapted to a smaller sized female threaded drainpipe connection, and illustrating one of a number of connections that can be made with the kit.

As shown in FIG. 3, the rubber cap 20 can have its skirt 22 fitted over a standard (e.g. 2 inch) pipe. In many cases (e.g. as shown in FIG. 2) the drainpipe will be such a pipe with a smooth cylindrical outer surface opening which the cap 22 can be directly secured by placing the cap over the pipe end and tightening the clamp 24. In other cases, the drainpipe access may be internal (female) threaded coupling such as that shown in FIG. 4. In that case, the cap 20 can be fitted to a male-threaded-to-smooth adaptor 62 as shown in FIG. 3 and threaded into the coupling 64 of FIG. 4.

For smaller sized drainpipes with male threads, the coupling 66 of FIG. 3 can be used with the cap 20. And if the smaller (e.g. 1½ inch diameter) drainpipe has female threading rather than male, the nipple coupling 68 can be threaded into the coupling 66 and into the drainpipe and the cap 20 attached to coupling 66.

A prototype kit substantially as shown and described above has been constructed and tested and shown to work well. This kit employed a six inch by six inch by twelve inch plastic carrying case as the container 12, a rubber cap that was about 1½ by 2¾ inches in overall size with the skirt section being about 1 inch in depth on the inside out 5/32 inch in thickness. The wall 26 was about ⅜ inch in thickness at the hole 28. The hole 28 was drilled to be ½ inch in diameter to receive a ⅜ inch rod 30. The tube 40 was a ¼ inch copper tube received in a 3/16 inch diameter hole through the wall 26. The nozzle is set off center being close to the skirt 22 (but separated sufficiently to allow couplers, such as couplers 62 and 66 to not block the tube 40).

Of course, the invention may be practiced in alternate ways and the above description of the prototype is offered for purposes of illustration and as a concrete example and is not meant to restrict the scope of the claimed invention.

While one embodiment of the invention have been shown and described, it will be obvious to those in the art that changes and modifications may be made without departing from the invention and, therefore, the aim in the appended claims is to cover all such changes and modifications as fall within the true spirit and scope of the invention.

I claim:

1. A kit for forming apparatus for the snaking of pipes comprising:

a rubber cap having a cylindrical skirt section sized to fit over a standard sized drainpipe, said cap being closed at one end of the skirt section except for the first opening therein sized to receive a flexible rotary snake rod and a second opening receiving a nozzle tube, said cap also having means for tightening said skirt section about a section of pipe of the outside diameter of said standard sized drainpipe, and said tube extending through the end of said rubber cap in a substantially waterproof manner and terminating at one end a short distance from the closed end of said rubber cap and having means for receiving a hose connection at its other end;

a hose coupled at one hose end to said nozzle tube at said other end of nozzle tube, said hose being of several feet in length and having means at its opposite end for coupling to a water spigot such as a kitchen sink's faucet;

means incorporated at said coupling means at said other end of said hose to provide positive back flow protection and to prevent the flow of fluids out of said hose into a faucet to which it is connected;

said kit further including means for adapting the rubber cap to a number of different standard sized drainpipes and drainpipe endings so as to allow the kit to be used in a large number of different snaking conditions; and said rubber closed end of said cap being of sufficient thickness about said first opening and said opening being sized to said snake rod's diameter such that the cap acts as a squeegee as the rod is pulled out of the cap and squeegees material off of the rod and allows such material to be flushed down a drainpipe to which the cap is attached.

2. The kit of claim 1 wherein:

said kit further includes a plurality of means for adapting and coupling said opposite end of said hose to any one of a number of standard faucets.

3. The kit of claim 1 wherein:

a plurality of couplings (16) for adapting the cap to fit on and be secured to different standard sized drainpipes with different threadings on the drainpipes.

* * * * *